US009981491B2

(12) United States Patent
Sakano et al.

(10) Patent No.: US 9,981,491 B2
(45) Date of Patent: May 29, 2018

(54) TAPE CARTRIDGE

(71) Applicant: Seiko Epson Corporation, Tokyo (JP)

(72) Inventors: Hideki Sakano, Suwa (JP); Shinsaku Kosuge, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/494,154

(22) Filed: Apr. 21, 2017

(65) Prior Publication Data

US 2017/0217228 A1 Aug. 3, 2017

Related U.S. Application Data

(63) Continuation of application No. 15/170,192, filed on Jun. 1, 2016, now Pat. No. 9,662,912, which is a (Continued)

(30) Foreign Application Priority Data

Mar. 24, 2014 (JP) ..... 2014-060918

(51) Int. Cl.
*B41J 15/04* (2006.01)
*B41J 32/00* (2006.01)
(Continued)

(52) U.S. Cl.
CPC ..... *B41J 15/044* (2013.01); *B41J 3/4075* (2013.01); *B41J 17/32* (2013.01); *B41J 17/36* (2013.01);
(Continued)

(58) Field of Classification Search
CPC ... B41J 32/02; B41J 33/10; B41J 35/16; B41J 15/044; B41J 3/4075; B41J 17/36; B41J 17/32; B41J 32/00
See application file for complete search history.

(56) References Cited

U.S. PATENT DOCUMENTS 5,595,447 A * 1/1997 Takayama ..... B41J 3/4075 400/231
5,921,688 A 7/1999 Furuya et al.
(Continued)

FOREIGN PATENT DOCUMENTS

CN 201989424 U 9/2011
JP A-H09-277679 10/1997
(Continued)

OTHER PUBLICATIONS

International Search Report, dated Jun. 9, 2015, issued in related Patent Application No. PCT/JP2015/058319.
(Continued)

*Primary Examiner* — Kristal Feggins
(74) *Attorney, Agent, or Firm* — ALG Intellectual Property, LLC

(57) ABSTRACT

A tape cartridge detachably installed on a cartridge installation portion of a tape printing apparatus having a first shaft and a second shaft on the cartridge installation portion. The tape cartridge includes a tape accommodation area in which a printing tape and a tape core are accommodated. A platen has a first reception portion in which the first shaft is inserted when the tape cartridge is installed, and a second reception portion into which the second shaft is inserted when the tape cartridge is installed in the cartridge installation portion. When seen from an attaching direction of the tape cartridge, the tape cartridge has an appearance that is formed in an L-shape and of which a base end at a right side surface slightly projects. The first reception portion and the second reception portion are arranged each other from opposite side of the tape accommodation portion.

13 Claims, 10 Drawing Sheets

Related U.S. Application Data continuation of application No. 14/741,317, filed on Jun. 16, 2015, now Pat. No. 9,387,712, which is a continuation of application No. PCT/JP2015/058319, filed on Mar. 19, 2015.

(51) Int. Cl.

| | |
|---|---|
| ***B65H 23/04*** | (2006.01) |
| ***B65H 23/032*** | (2006.01) |
| ***B65H 23/18*** | (2006.01) |
| ***B41J 17/32*** | (2006.01) |
| ***B41J 3/407*** | (2006.01) |
| ***B41J 17/36*** | (2006.01) |

(52) U.S. Cl.

CPC ..... *B41J 32/00* (2013.01); *B65H 23/032* (2013.01); *B65H 23/04* (2013.01); *B65H 23/18* (2013.01)

(56) References Cited

U.S. PATENT DOCUMENTS

| | | | |
|---|---|---|---|
| 7,234,883 | B2 | 6/2007 | Yamamoto |
| 8,757,907 | B2 | 6/2014 | Yamaguchi et al. |
| 8,764,325 | B2 | 7/2014 | Yamaguchi et al. |
| 2010/0247209 | A1 | 9/2010 | Yamaguchi et al. |
| 2010/0247210 | A1 | 9/2010 | Yamaguchi et al. |
| 2011/0316956 | A1 | 12/2011 | Kakuta et al. |
| 2012/0008999 | A1 | 1/2012 | Yamaguchi et al. |
| 2012/0080550 | A1 | 4/2012 | Yamaguchi et al. |
| 2012/0188325 | A1 | 7/2012 | Yamaguchi et al. |
| 2012/0189366 | A1 | 7/2012 | Yamaguchi et al. |
| 2012/0201588 | A1 | 8/2012 | Yamaguchi et al. |
| 2014/0175204 | A1 | 6/2014 | Yamaguchi et al. |
| 2015/0183246 | A1 | 7/2015 | Yamaguchi et al. |

FOREIGN PATENT DOCUMENTS

| | | | |
|---|---|---|---|
| JP | 2002-178572 | A | 6/2002 |
| JP | 2010-234694 | A | 10/2010 |
| JP | 2010-234698 | A | 10/2010 |
| JP | 2012-086568 | A | 5/2012 |
| JP | 2012-126141 | A | 7/2012 |
| JP | 2013-141749 | A | 7/2013 |

OTHER PUBLICATIONS

Non-Final Office Action received in U.S. Appl. No. 14/741,317, dated Nov. 12, 2015.

Notice of Allowance and Notice of Allowability received in U.S. Appl. No. 14/741,317, dated Mar. 14, 2016.

Supplemental Notice of Allowability received in U.S. Appl. No. 14/741,317, dated May 4, 2016.

Non-Final Office Action received in U.S. Appl. No. 15/170,192, dated Sep. 15, 2016.

Notice of Allowance and Notice of Allowability received in U.S. Appl. No. 15/170,192, dated Jan. 27, 2017.

* cited by examiner

TAPE CARTRIDGE

CROSS REFERENCE TO RELATED APPLICATION

The present application is a continuation application of U.S. patent application Ser. No. 15/170,192 filed on Jun. 1, 2016, which is a continuation application of U.S. patent application Ser. No. 14/741,317 filed on Jun. 16, 2015, which is a continuation of PCT Application No. PCT/JP2015/058319 filed on Mar. 19, 2015, which claims priority to Japanese Patent Application No. 2014-060918 filed on Mar. 24, 2014, the contents of which are incorporated herein by reference.

BACKGROUND

1. Technical Field

The present invention relates to a tape cartridge installed on the cartridge installation portion of a tape printing apparatus and subjected to printing by the tape printing apparatus.

2. Background Art

Up until now, a tape cassette detachably installed on the cassette installation portion of a tape printing apparatus has been known as such a tape cartridge (see JP-A-2012-126141).

The tape cassette accommodates a tape feeding roller, a first tape spool on which a first tape is wound, a ribbon spool on which an ink ribbon is wound, and a ribbon winding-up spool that winds up the ink ribbon. In addition, the cassette casing of the tape cassette has a roller supporting hole corresponding to the tape feeding roller, a first tape supporting hole corresponding to the first tape spool, and a winding-up supporting hole corresponding to the ribbon winding-up spool. Moreover, the cassette casing has a guide hole for guiding the installation of the tape cassette and two pin holes for positioning the cassette casing.

On the other hand, on the cassette installation portion of the tape printing apparatus, a tape driving shaft corresponding to the roller supporting hole, a ribbon winding-up shaft corresponding to the winding-up supporting hole, a guide shaft corresponding to the guide hole, and two positioning pins corresponding to the two pin holes are provided to stand.

When the tape cassette is installed on the cassette installation portion, the tape driving shaft is fitted in the tape feeding roller, the ribbon winding-up shaft is fitted in the ribbon winding-up spool, the guide shaft is inserted in the guide hole, and the two positioning pins are inserted in the two pin holes.

In this case, the tape driving shaft and the guide shaft largely project from the cassette installation portion, and the tape feeding roller (the roller supporting hole) and the guide hole corresponding to the tape driving shaft and the guide shaft, respectively, are diagonally arranged in the tape cassette when seen in plan view. Thus, the tape cassette is accurately and smoothly installed on the cassette installation portion.

In such a known tape cassette (tape cartridge), if the roller supporting hole and the guide hole do not substantially separate from each other, the attachment/detachment of the tape cassette is not smoothly performed since the tape cassette is inclined. In addition, if portions for grasping the tape cassette, the roller supporting hole, and the guide hole are not arranged in a balanced manner, a force for installing or withdrawing the tape cassette is biased. In this case as well, the attachment/detachment of the tape cassette is not smoothly performed since a twist is caused when the tape cassette is inclined.

The present invention has an object of providing a tape cartridge that can be smoothly attached/detached to/from a cartridge installation portion with its grasping portions and guided portions arranged in a balanced manner.

SUMMARY OF THE INVENTION

According to the present invention, there is provided a tape cartridge detachably installed on a cartridge installation portion of a tape printing apparatus having a first shaft and a second shaft on the cartridge installation portion. The tape cartridge includes two grasping portions that allow the tape cartridge to be grasped with fingers when the tape cartridge is installed to or detached from the tape printing apparatus and are disposed at two opposite places on a side surface of the tape cartridge, and a platen that has a first reception portion in which the first shaft is inserted when the tape cartridge is installed in the cartridge installation portion, and a second reception portion into which the second shaft is inserted when the tape cartridge is installed in the cartridge installation portion, wherein, when seen from an attaching direction of the tape cartridge, the second reception portion is positioned on an opposite side over an imaginary line connecting the two grasping portions with respect to the first reception portion and disposed at a position to which one of the two grasping portions farther from the first reception portion is closer than the other of the two grasping portions.

According to this configuration, the second reception portion is disposed over the imaginary line connecting the grasping portions at the two places together with respect to the first reception portion and disposed at the position closer to one grasping portion farther from the first reception portion than the other grasping portion among the grasping portions at the two places. Therefore, the distance between the first reception portion and the second reception portion is increased, and the first reception portion and the second reception portion are diagonally positioned in a balanced manner. Thus, a force applied via the grasping portions when the tape cartridge is attached/detached is relatively uniformly applied to the first reception portion and the second reception portion. As a result, the attachment/detachment of the tape cartridge to/from the cartridge installation portion can be smoothly performed. In addition, the first reception portion and the second reception portion exist at the far and easily-identifiable places when seen from the upper side and the lower side of the tape cartridge. Accordingly, when the tape printing apparatus is put in front of the eyes and the tape cartridge is picked up while seeing the cartridge installation portion, the first reception portion and the second reception portion function as marks by which the front and rear direction of the tape cartridge and the back and forth and the right and left directions thereof are easily identifiable. Thus, the tape cartridge can be oriented in a proper direction and installed on the cartridge installation portion.

In this case, the second reception portion is preferably disposed at a position farthest from the first reception portion on the tape cartridge when seen from the attaching direction of the tape cartridge.

According to this configuration, the second reception portion is disposed at the position farthest from the first reception portion over the imaginary line connecting the grasping portions at the two places together. Therefore, the force applied via the grasping portions when the tape cartridge is attached/detached is relatively uniformly applied to the first reception portion and the second reception portion. As a result, the attachment/detachment of the tape cartridge to/from the cartridge installation portion can be smoothly performed. In addition, since the second reception portion is arranged to substantially separate from the first reception portion, a force for installing or withdrawing the tape cartridge is hardly biased. In this case as well, the attachment/detachment of the tape cartridge to/from the cartridge installation portion can be smoothly performed.

In addition, the second reception portion preferably includes a penetratingly-formed through hole.

Moreover, the tape cartridge preferably includes a cartridge casing having a shell structure made of a top wall portion on a near side in the attaching direction and a bottom wall portion on a back side in the attaching direction and a peripheral wall portion, and the second reception portion is preferably provided on the peripheral wall portion or in a vicinity of the peripheral wall portion.

According to these configurations, the tape cartridge having a different thickness can also be used.

In addition, the through hole preferably includes a first through hole penetratingly formed on the top wall portion and a second through hole penetratingly formed on the bottom wall portion.

According to this configuration, a twist in the second shaft of the second reception portion can be reduced at the early stage of the attachment of the tape cartridge and at the last stage of the detachment thereof.

Moreover, the tape cartridge preferably includes a cartridge casing, and the second reception portion preferably includes a guide groove recessed on an outer peripheral surface of the cartridge casing.

In this case, the groove is preferably recessed in a direction crossing an imaginary line connecting the first reception portion and the second reception portion together.

According to these configurations, the second reception portion can be arranged to separate from the first reception portion to a greater extent, and a twist in the second shaft of the second reception portion can be reduced. Accordingly, the attachment/detachment of the tape cartridge to/from the cartridge installation portion can be smoothly performed.

On the other hand, the platen is preferably includes a platen roller having the first reception portion and rotatably supported by the first shaft via the first reception portion when the tape cartridge is installed on the cartridge installation portion.

In this case, the first reception portion is preferably a shaft hole.

According to these configurations, the shaft rotatably supporting the platen roller can also serve as the first shaft, and thus the number of components for guiding the attachment/detachment of the tape cartridge can be reduced.

In this case, the first reception portion preferably serves not only as a shaft hole but also as a through hole.

According to this configuration, the first reception portion can also have the function of supporting the platen shaft.

In this case, the first reception portion and the second reception portion are preferably guide holes.

According to this configuration, when the first shaft and the second shaft are inserted in the first reception portion and the second reception portion, respectively, the tape cartridge can be accurately positioned at the cartridge installation portion of the tape printing apparatus and prevented from moving while being installed.

In this case, the second reception portion is preferably a guide groove.

According to this configuration, the first reception portion and the second reception portion can be set at positions farthest from each other, and the function of positioning the tape cartridge with high accuracy can be obtained.

In this case, the grasping portions are preferably convex portions provided on the peripheral wall portion.

According to this configuration, the grasping portions are provided at easily-handled positions, and the fingers are hardly slipped. Therefore, the tape cartridge can be reliably grasped.

In this case, the grasping portions are preferably positioned to face hollowed portions of a surrounding wall surface of the cartridge installation portion when the tape cartridge is installed in the cartridge installation portion.

According to this configuration, the tape cartridge can be easily grasped and attached/detached to/from the cartridge installation portion.

DETAILED DESCRIPTION OF THE EMBODIMENTS

Hereinafter, a description will be given, with reference to the accompanying drawings, of a tape cartridge according to an embodiment of the present invention in conjunction with a tape printing apparatus in which the tape cartridge is installed. The tape printing apparatus is used to perform printing while feeding out a printing tape and an ink ribbon from the installed tape cartridge and cut off a printed part of the printing tape to create a label (tape piece).

[Outline of Tape Printing Apparatus]

Figure 1:
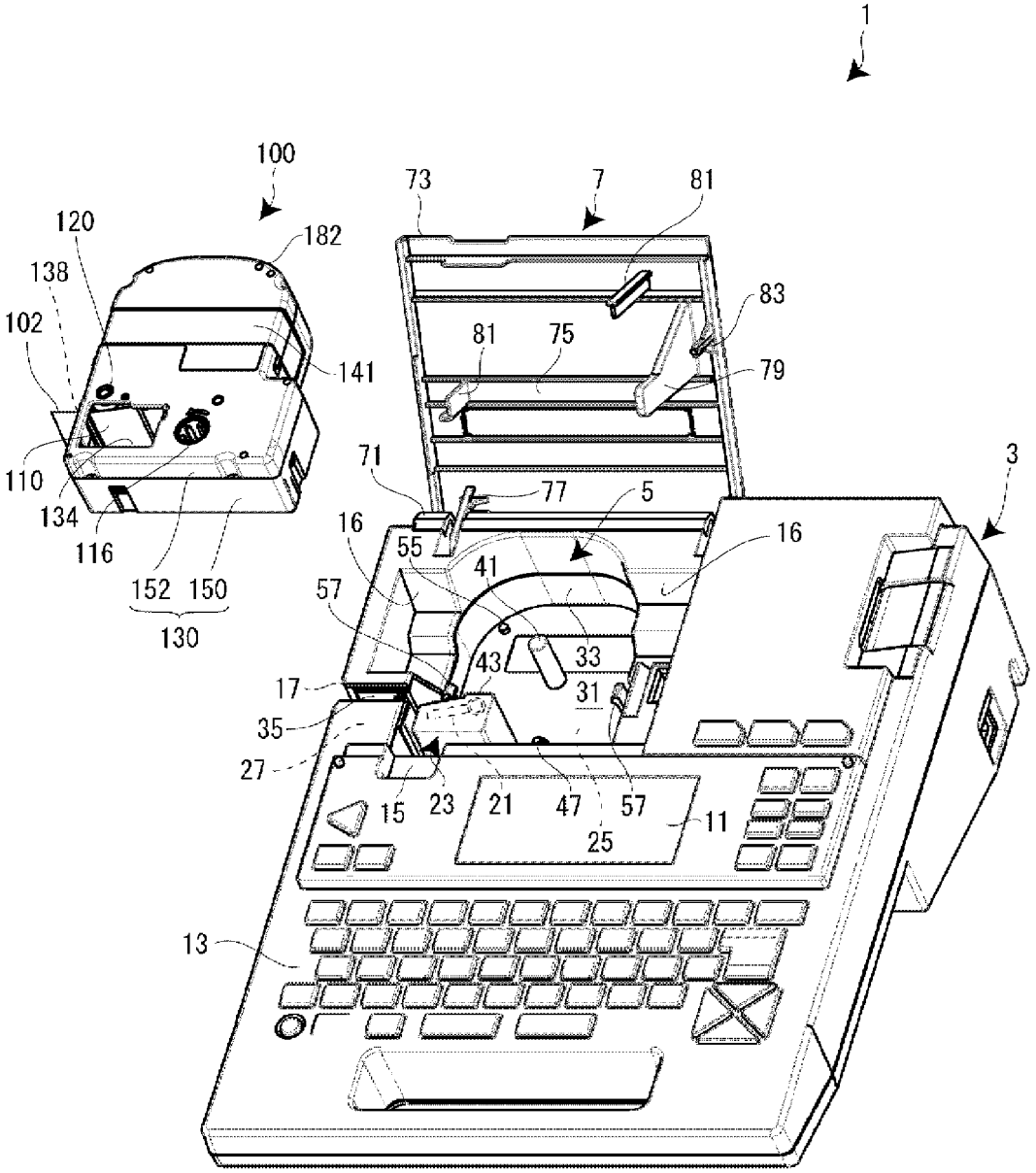
FIG. 1 is an external perspective view of a tape printing apparatus according to an embodiment with its cover opened.

FIG. 1 is an external perspective view of the tape printing apparatus and the tape cartridge installed in the tape printing apparatus. As shown in the figure, a tape printing apparatus 1 includes an apparatus casing 3 constituting an outer shell, a cartridge installation portion 5 on which a tape cartridge 100 is detachably installed, and an opening/closing cover 7 used to open/close the cartridge installation portion 5. At the upper surface of the apparatus casing 3, the cartridge installation portion 5 is provided on the back side, a display 11 is provided on the central side, and a keyboard 13 is provided on the near side. In the vicinity of the opening/closing cover 7, a finger-hooking recessed portion 15 is provided. The opening/closing cover 7 is opened when the recessed portion 15 is hooked and raised by a finger. Further, on the side surface (left side surface) of the apparatus casing 3, an elongated tape ejection port 17 is provided to eject a printing tape 102.

In addition, the tape printing apparatus 1 includes a printing mechanism portion 23 having a printing head 21 provided to stand on the cartridge installation portion 5, a tape feeding mechanism portion 25 embedded in the back side space of the cartridge installation portion 5, and a tape cutting mechanism portion 27 embedded in the vicinity of the tape ejection port 17. A user enters printing information via the keyboard 13 and performs printing with a key operation after confirming the printing information on the display 11. Upon the printing instruction, the tape feeding mechanism portion 25 is driven to make the printing tape 102 and the ink ribbon 110 run parallel to each other. Moreover, by heat applied from the printing mechanism portion 23 to the ink ribbon 110, the ink of the ink ribbon 110 is transferred to the printing tape 102 to perform the printing. By the print feeding, the printing tape 102 is ejected from the tape ejection port 17. When the printing is completed, the tape cutting mechanism portion 27 is driven to cut off a printed part of the printing tape 102.

[Outline of Tape Cartridge]

As shown in FIGS. 2A and 2B and FIGS. 5A and 5B, the tape cartridge 100 includes a tape roll 106 in which the printing tape 102 is wound on a tape core 104 and a ribbon roll 114 in which the ink ribbon 110 is wound on a feeding-out core 112. In addition, the tape cartridge 100 includes a winding-up core 116 that winds up the ink ribbon 110 that has been consumed and a platen roller 120 (platen) that comes in contact with the printing head 21 and feeds the printing tape 102 and the ink ribbon 110. Moreover, the tape cartridge 100 includes a cartridge casing 130 that accommodates the tape roll 106, the ribbon roll 114, the winding-up core 116, and the platen roller 120. As described above, the tape cartridge 100 of this embodiment has so-called a shell structure in which the outer shell is covered with the cartridge casing 130.

Further, the tape cartridge 100 includes an insertion opening 134, in which the printing head 21 is inserted when the tape cartridge 100 is installed in the tape printing apparatus 1, on the cartridge casing 130. The tape cartridge 100 includes a tape delivering port 138 that is formed on the cartridge casing 130 and from which the printing tape 102 is delivered. Note that as will be described in detail later, the tape roll 106 is rotatably supported by a cylindrical core shaft 192 projecting inside the cartridge casing 130.

When the platen roller 120 and the winding-up core 116 are driven by the tape feeding mechanism portion 25, the printing tape 102 is fed out from the tape core 104 and the ink ribbon 110 is fed out from the feeding-out core 112. The fed-out printing tape 102 and the ink ribbon 110 run parallel to each other at the platen roller 120 and are subjected to printing by the printing head 21. A fed-out end (printed part) of the printing tape 102, on which the printing has been performed, is delivered from the tape delivering port 138 to the tape ejection port 17. On the other hand, the ink ribbon 110 goes around the peripheral wall part of the insertion opening 134 and is wound up by the winding-up core 116. Note that a plurality of types of tape cartridges having a different thickness is available as the tape cartridge 100 according to a tape width of the printing tape 102.

[Details of Tape Printing Apparatus]

Figure 3:
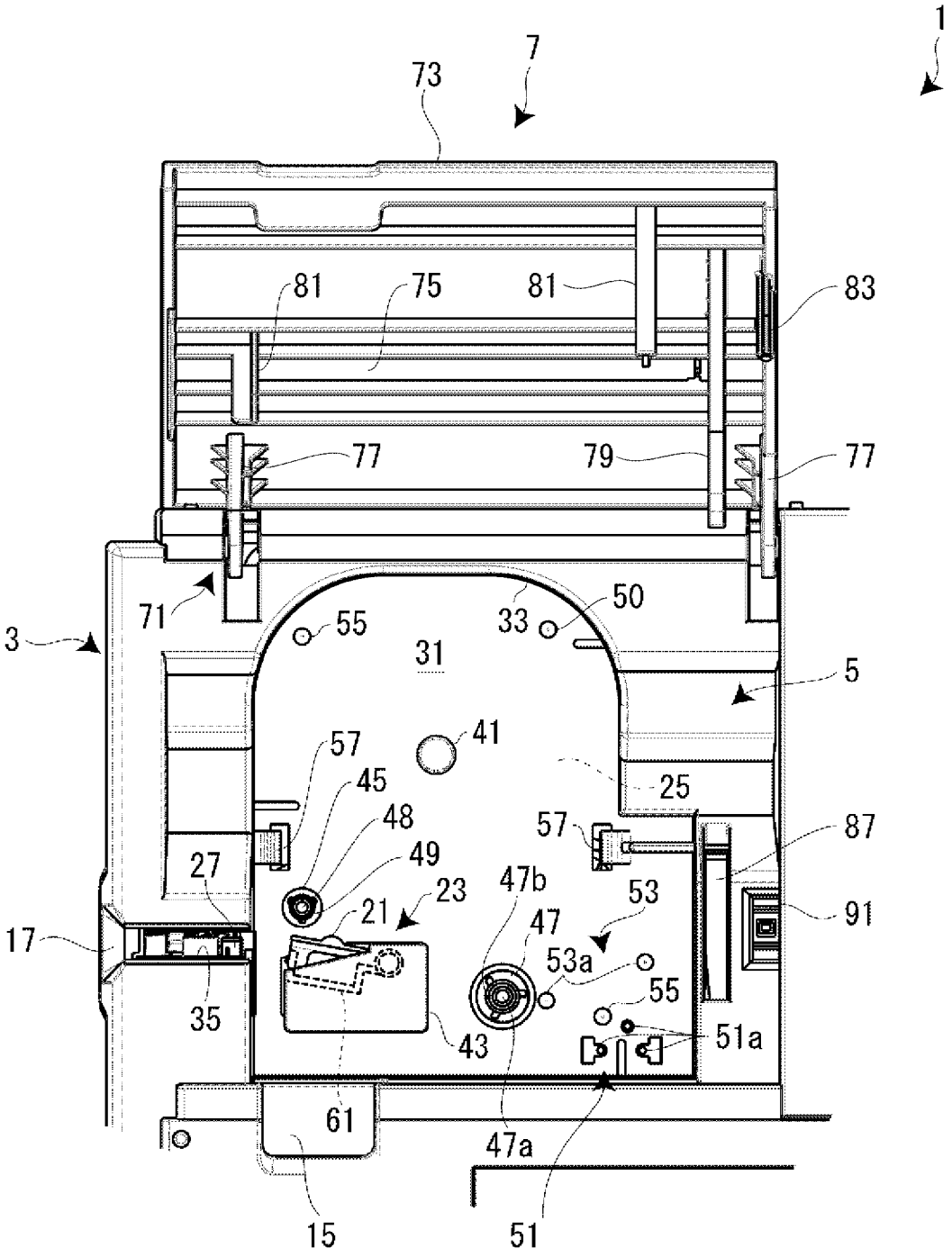
FIG. 3 is a plan view of a cartridge installation portion.

As shown in FIG. 1 and FIG. 3, the cartridge installation portion 5 is formed in a flat shape complementary to the flat shape of the tape cartridge 100 and formed to be recessed with a depth corresponding to the tape cartridge 100 having a maximum thickness among the plurality of types of installable tape cartridges 100. In this case, an installation base 31 constituting the bottom plate portion of the cartridge installation portion 5 and a side plate portion 33 are integrally formed (molded) by a resin or the like. A slit-shaped tape ejection path 35 is formed between the cartridge installation portion 5 and the tape ejection port 17, and the tape cutting mechanism portion 27 is embedded at this part.

On the installation base 31 of the cartridge installation portion 5, a positioning projection 41 in which the core shaft 192 is fitted and positioned, the printing head 21 covered with a head cover 43, a platen driving shaft 45 that rotates and drives the platen roller 120, and a winding-up driving shaft 47 that rotates and drives the winding-up core 116 are provided to stand. In addition, a guide pin 50 is provided to stand at a position diagonally to the platen driving shaft 45. Moreover, on the installation base 31, a tape detection portion 51 that detects a type (attribute information) of the printing tape 102 and a core releasing portion 53 that releases the rotation-stop of the feeding-out core 112 and the winding-up core 116 are provided in the vicinity of the winding-up driving shaft 47.

Moreover, on the installation base 31, a pair of small projections 55 is provided at the diagonal positions. In addition, a pair of retaining pieces 57 that retain the intermediate part of the installed tape cartridge 100 is provided. On the other hand, in the back side space of the installation base 31, the tape feeding mechanism portion 25 constituted of a motor, a gear train (each not shown), or the like that rotates the platen driving shaft 45 and the winding-up driving shaft 47 is embedded. The tape feeding mechanism portion 25 branches power with the gear train and causes the platen driving shaft 45 and the winding-up driving shaft 47 to rotate in synchronization with each other.

The printing mechanism portion 23 includes the printing head 21 constituted of a thermal head and a head support frame 61 that supports and rotates the printing head 21. In addition, the printing mechanism portion 23 includes a head releasing mechanism (not shown) that rotates the printing head 21 between a printing position and a retracting position via the head support frame 61 and the head cover 43 that covers the printing head 21 (and the head support frame 61).

The head releasing mechanism operates as the opening/closing cover 7 is opened/closed. The head releasing mechanism moves (rotates) the printing head 21 to the printing position according to the closing operation of the opening/closing cover 7 and moves (rotates) the printing head 21 to the retracting position according to the opening operation thereof. The printing head 21 comes in contact with the platen roller 120 via the ink ribbon 110 and the printing tape 102 when moving to the printing position and separates from the platen roller 120 when moving to the retracting position. Thus, the printing tape 102 and the ink ribbon 110 are prevented from interfering with the printing head 21 when the tape cartridge 100 is attached to or detached from the tape printing apparatus 1.

The printing head 21 is provided with a plurality of heat generation elements, and the plurality of heat generation elements lines up in the same direction as the shaft direction of the platen roller 120. Further, printing is performed when the printing tape 102 and the ink ribbon 110 are fed and the plurality of heat generation elements is selectively driven.

The head cover 43 is formed in a substantially rectangle shape in plan view and integrally formed (molded) with the installation base 31 (the cartridge installation portion 5). In addition, the head cover 43 vertically largely projects from the installation base 31. The head cover 43 internally allows the rotation of the printing head 21 and externally functions as an installation guide for the tape cartridge 100.

The tape detection portion 51 is constituted of a plurality of micro switches 51*a*, selectively engages with a detected portion 180, which will be described later, of the tape cartridge 100, and detects a type such as a tape width, a tape color, and a material of the printing tape 102. Further, based on the detection result, the driving of the printing head 21 and the tape feeding mechanism portion 25 is controlled.

The core releasing portion 53 is constituted of two releasing pins 53*a* for the feeding-out core 112 and the winding-up core 116. As will be described in detail later, the cartridge casing 130 is provided with rotation-stop hooks 206 retained by the feeding-out core 112 and the winding-up core 116, respectively (see FIG. 6). When the tape cartridge 100 is installed, the releasing pins 53*a* engage with the rotation-stop hooks 206 to release the rotation-stop of the feeding-out core 112 and the winding-up core 116.

The platen driving shaft 45 includes a platen supporting shaft 48 elongated so to be inserted in the platen roller 120 and a spline-shaped rotation driving shaft 49 rotatably journaled in the base portion of the platen supporting shaft 48 (see FIG. 3). The rotation power of the tape feeding mechanism portion 25 is transmitted to the rotation driving shaft 49 and then transmitted from the rotation driving shaft 49 to the platen roller 120 (that will be described in detail later).

Similarly, the winding-up driving shaft 47 includes a fixation shaft 47*a* and a spline-shaped movable shaft 47*b* rotatably journaled in the fixation shaft 47*a*. In this case as well, the rotation power of the tape feeding mechanism portion 25 is transmitted to the movable shaft 47*b* and then further transmitted from the movable shaft 47*b* to the winding-up core 116.

When the tape cartridge 100 is installed on the cartridge installation portion 5, the core shaft 192 (the tape core 104) engages with the positioning projection 41, the platen roller 120 engages with the platen driving shaft 45, and the winding-up core 116 engages with the winding-up driving shaft 47. Then, when the opening/closing cover 7 is closed, the printing head 21 rotates and comes in contact with the platen roller 120 with the printing tape 102 and the ink ribbon 110 held therebetween, which brings the tape printing apparatus 1 in a printing standby state.

Figure 4:
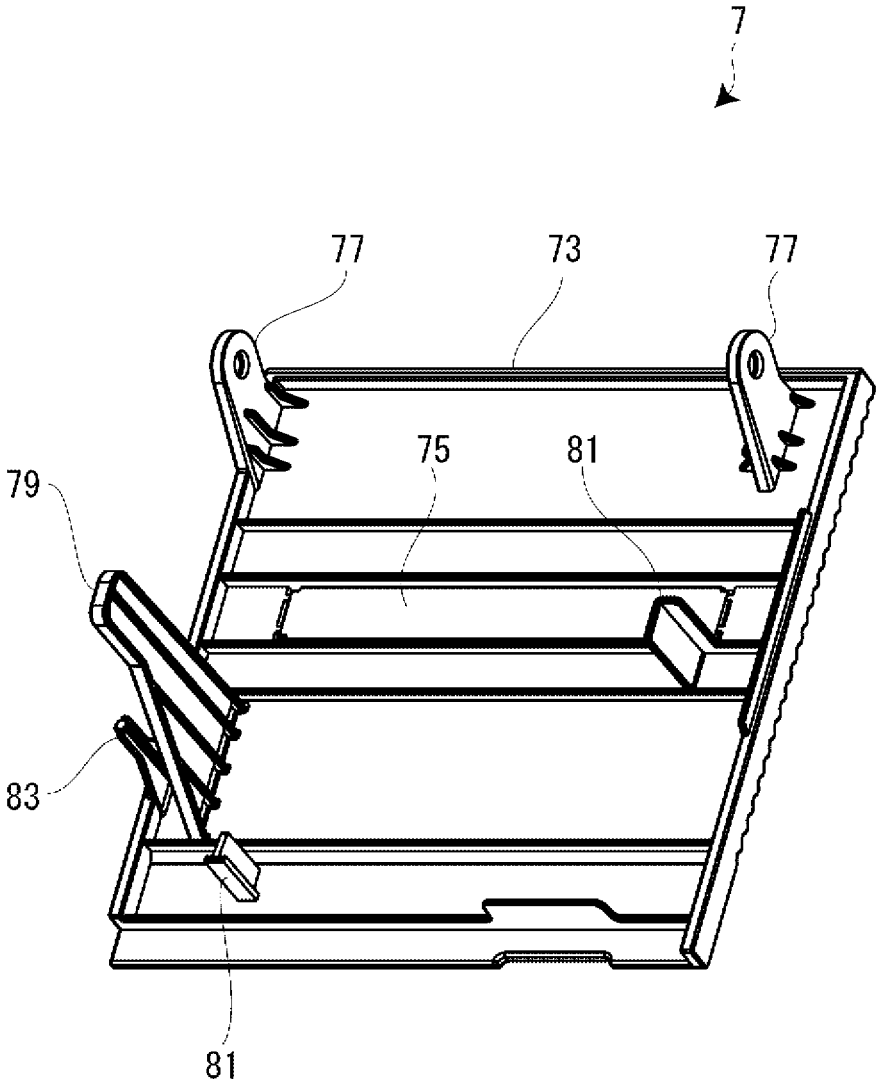
FIG. 4 is a perspective view of the opening/closing cover when seen from the side of its rear surface.

As shown in FIG. 1 and FIG. 4, the opening/closing cover 7 is rotatably, i.e., openably/closably attached to the apparatus casing 3 via a hinge portion 71 provided on the back side. The opening/closing cover 7 includes an opening/closing cover main body 73 and a check window 75 provided at the center of the opening/closing cover main body 73. In addition, opening/closing cover 7 includes a pair of journaled pieces 77 that projects from the rear surface of the opening/closing cover main body 73 and is rotatably journaled in the hinge portion 71 and an operation lever 79 that projects from the rear surface of the opening/closing cover main body 73 and rotates the printing head 21. Moreover, the opening/closing cover 7 includes two pressing projections 81 that project from the rear surface of the opening/closing cover main body 73 and press the tape cartridge 100 and a pressing projection 83 that projects from the rear surface of the opening/closing cover main body 73 and operates (turns ON) an embedded cover closing detection switch (not shown).

The check window 75 is formed to be long from side to side and made of a transparent (visible-light transparent) resin formed separately from the opening/closing cover main body 73. Through the check window 75, (a type and a tape remaining amount of the printing tape 102 of) the tape cartridge 100 installed on the cartridge installation portion 5 can be visually checked. In addition, the pair of journaled pieces 77, the operation lever 79, the pressing projections 81, the pressing projection 83, and the pressing portion 85 are integrally formed (molded) with the opening/closing cover main body 73 by a resin.

The operation lever 79 largely projects from the rear surface of the opening/closing cover main body 73 and is inserted in a slit opening 87 provided on the lateral side of the cartridge installation portion 5 as the opening/closing cover 7 is closed. The operation lever 79 inserted in the slit opening 87 causes the head releasing mechanism described above to operate and the printing head 21 to rotate. Similarly, as the opening/closing cover 7 is closed, the pressing projection 83 is inserted in a rectangle opening 91 adjacent to the slit opening 87 to operate (turn "ON") the cover closing detection switch. One of the pressing projections 81 is positioned so as to be in the vicinity of the platen roller 120 of the tape cartridge 100 and presses the tape cartridge 100 so as to be set on the installation base 31 of the cartridge installation portion 5 with the closing of the opening/closing cover 7.

[Details of Tape Cartridge]

Next, a description will be given in detail of the tape cartridge 100 with reference to FIGS. 2A and 2B, FIGS. 5A and 5B, and FIG. 6. Note that in the description of the tape cartridge 100, taking FIGS. 2A and 2B as an example, a surface on the near side in the installation direction, i.e., on the upper front side of the tape cartridge 100 will be called a "front surface," a surface on the back side in the installation direction, i.e., on the opposite side of the tape cartridge 100 will be called a "rear surface," a side surface on the left side of the tape cartridge 100 will be called a "left side surface," a side surface on the right side thereof will be called a "right side surface," an arc-shaped side surface on the upper side thereof will be called a "tip end surface," and a side surface on the lower side thereof will be called a "base end surface."

As described above, the tape cartridge 100 includes the cartridge casing 130 and the tape roll 106, the ribbon roll 114, the winding-up core 116, and the platen roller 120 accommodated in the cartridge casing 130. In addition, the tape cartridge 100 includes the insertion opening 134 provided on the cartridge casing 130, the tape delivering port 138 formed on the left side surface in the vicinity of the platen roller 120, and an identification label 141 (see FIG. 1) affixed from the left side surface to the right side surface via the front surface at a position at which the tape roll 106 is accommodated. On the identification label 141, a tape width, a tape color, a material, and the like of the printing tape 102 accommodated in the cartridge casing 130 are displayed at the two places of the front surface and the left side surface.

The cartridge casing 130 constitutes the outer shell of the tape cartridge 100 (the shell structure) and has an appearance that is formed in an "L"-shape in plan view and of which the base end at the right side surface slightly projects. In the front and rear direction, the cartridge casing 130 is constituted of a lower casing 150 and an upper casing 152, the lower casing 150 and the upper casing 152 being positioned on the back side and the near side, respectively, when the cartridge casing 130 is installed on the cartridge installation portion 5. In the cartridge casing 130 of the embodiment, the upper casing 152 is constituted of a transparent resin molded item, and the lower casing 150 is constituted of a non-transparent resin molded item.

The upper casing 152 is such that a top wall portion 156 constituting the front surface of the cartridge casing 130 and an upper peripheral wall portion 158 suspending on the periphery of the top wall portion 156 are integrally formed (molded). In addition, the lower casing 150 is such that a bottom wall portion 160 constituting the rear surface of the cartridge casing 130, a lower peripheral wall portion 162 provided to stand on the periphery of the bottom wall portion 160, and an opening peripheral wall portion 164 provided to stand on the bottom wall portion 160 so as to define the insertion opening 134 are integrally formed (molded).

On the lower end surface of the upper peripheral wall portion 158 of the upper casing 152, a plurality of joining pins 170 is provided at appropriate intervals. While, on the lower peripheral wall portion 162 of the lower casing 150, a plurality of joining holes 172 is provided corresponding to the plurality of joining pins 170 (see FIGS. 5A and 5B). After constituents such as the tape roll 106 and the ribbon roll 114 are disposed on the lower casing 150, the upper casing 152 is joined to the lower casing 150 so as to press-fit the plurality of joining pins 170 in the plurality of joining holes 172, whereby the tape cartridge 100 is assembled. Note that the respective joining holes 172 are formed as through holes from the viewpoint of molding easiness.

In addition, a guided portion 182, in which the guide pin 50 is inserted, is provided at a position diagonally to the platen roller 120 in plan view. Specifically, the guided portion 182 is constituted of a first through hole 184 formed to penetrate the top wall portion 156 of the upper casing 152 and a second through hole 186 formed to penetrate the bottom wall portion 160 of the lower casing 150 (that will be described in detail later).

Figure 2A:
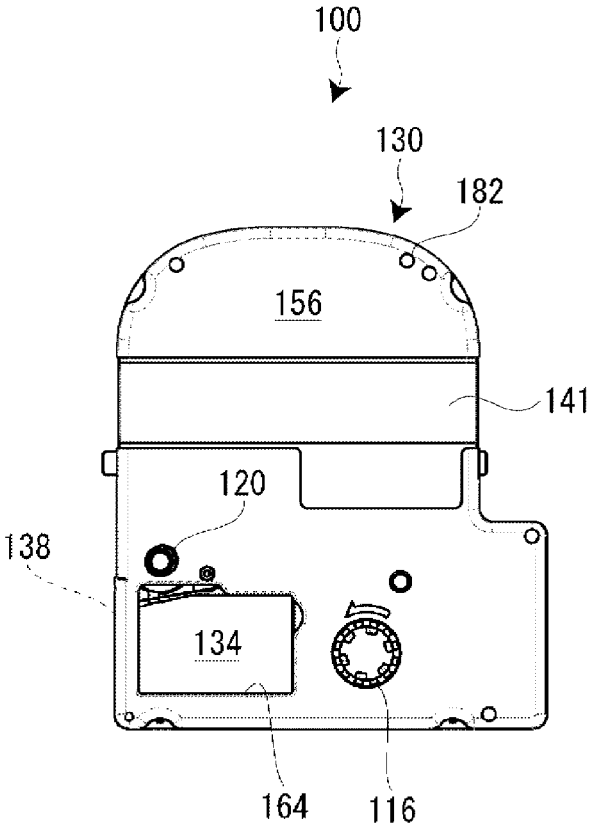
FIGS. 2A and 2B are, respectively, a plan view and a side surface view of a tape cartridge according to the embodiment.
Figure 2B:
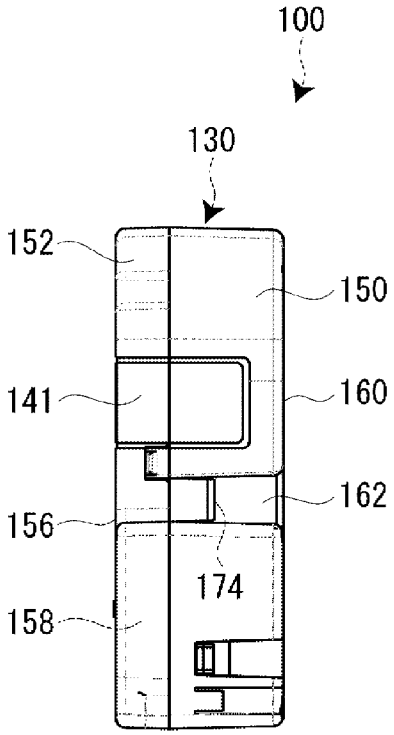
Figure 6:
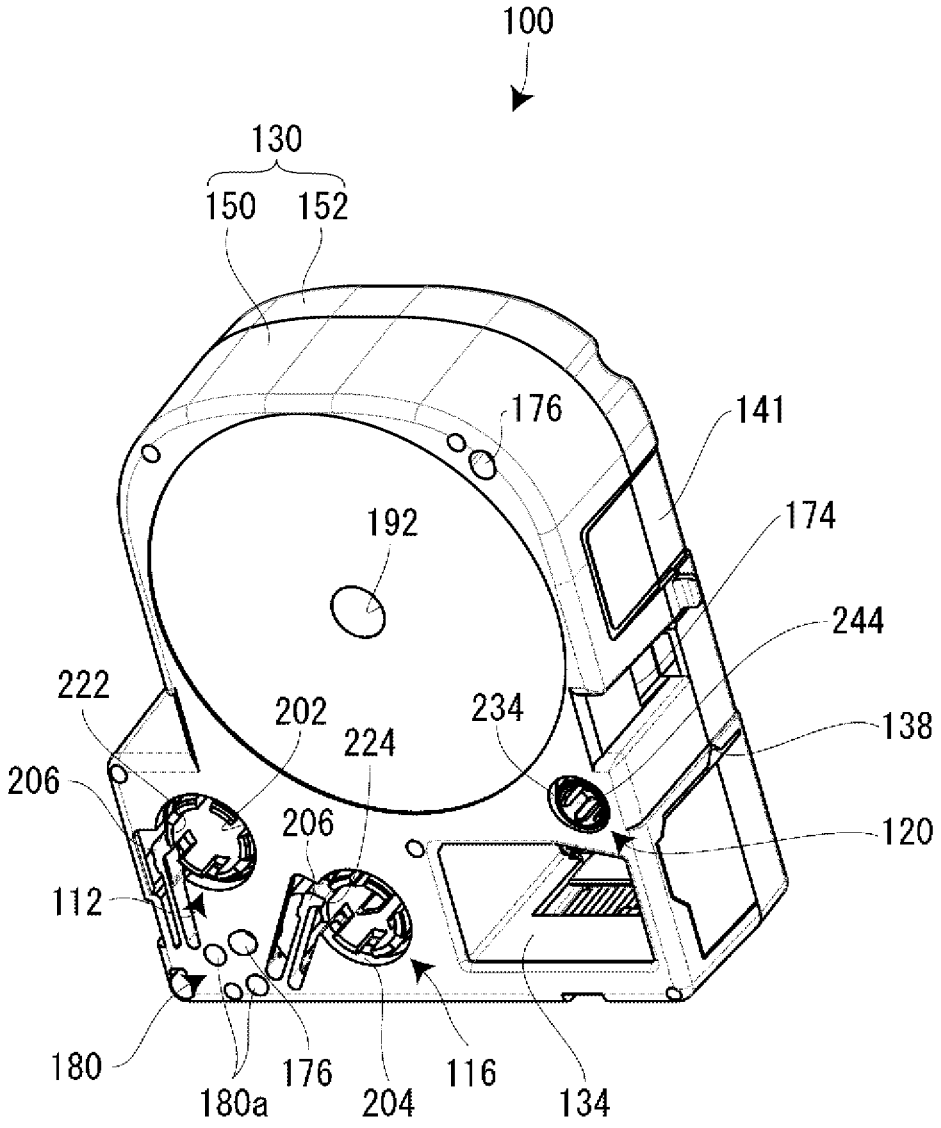
FIG. 6 is a perspective view of the tape cartridge when seen from the side of the rear surface.

On the other hand, on the left side surface and the right side surface of the lower casing 150, a pair of retaining-reception portions 174 retained by the pair of retaining pieces 57 is provided (see FIGS. 2A and 2B and FIG. 6). When the pair of retaining-reception portions 174 of the installed tape cartridge 100 is retained by the pair of retaining pieces 57 on the side of the cartridge installation portion 5, the tape cartridge 100 is prevented from floating. In addition, on the rear surface of the lower casing 150, small fitting holes 176 in which the pair of small projections 55 fits with slight room are provided (see FIG. 6). When the pair of small projections 55 on the side of the cartridge installation portion 5 fits in the pair of small fitting holes 176 of the installed tape cartridge 100, the tape cartridge 100 is easily positioned on the installation base 31.

Moreover, on the rear surface of the lower casing 150, the detected portion 180 corresponding to the detection portion 51 is provided at a left corner part on the side of the base end surface (i.e., at a right corner part as seen from the side of the front surface) (see FIG. 6). The detected portion 180 is constituted at a place corresponding to the plurality of micro switches 51*a* of the tape detection portion 51, and a plurality of bit patterns is obtained based on the presence or absence of reception holes 180*a* provided at the portion. That is, the bit patterns correspond to a type of the printing tape 102.

As shown in FIG. 5, in upper side space (on the side of the tip end surface) inside the cartridge casing 130, a tape accommodation area 190 in which the tape roll 106 is widely accommodated is constituted. At the center of the tape accommodation area 190, the core shaft 192 integrally formed (molded) with the lower casing 150 is provided to stand. The core shaft 192 is formed in a cylindrical shape, and the tape roll 106 (the tape core 104) is rotatably journaled in the outer peripheral surface of the core shaft 192. In addition, in the tape accommodation area 190, a tape guide 194 that guides the fed-out printing tape 102 to the platen roller 120 is integrally formed with the lower casing 150 so as to stand in the vicinity of the platen roller 120.

That is, inside the cartridge casing 130, a tape feeding path 196 ranging from the tape roll 106 as a starting point to the tape delivering port 138 via the tape guide 194 and the platen roller 120 is constituted. The printing tape 102 fed out from the tape roll 106 is guided to the platen roller 120 via the tape guide 194 and subjected to printing by the platen roller 120. Then, the printing tape 102 is further guided from the platen roller 120 to the tape delivering port 138.

The tape roll 106 includes two films 198 affixed to both end surfaces of the roll-shaped printing tape 102, besides the printing tape 102 and the tape core 104. The two films 198 prevent the printing tape 102 wound on the tape core 104 from spreading out. In addition, although not shown in the figures, a reverse-rotation stop mechanism is embedded in the tape core 104. When the tape cartridge 100 is carried, the reverse rotation of the printing tape 102 is prevented by the reverse-rotation stop mechanism. On the other hand, when the tape cartridge 100 is installed on the cartridge installation portion 5 of the tape printing apparatus 1, the reverse-rotation stop of the reverse-rotation stop mechanism is released by the positioning projection 41, whereby the feeding of the printing tape 102 is made possible.

On the right side of a base portion inside the cartridge casing 130, a ribbon accommodation area 200 is constituted adjacent to the insertion opening 134. In the ribbon accommodation area 200, a feeding-out-side bearing portion 202 that rotatably supports the ribbon roll 114 (the feeding-out core 112) and a winding-up-side bearing portion 204 that rotatably supports the winding-up core 116 are integrally formed with the cartridge casing 130 on the right and left parts, respectively. That is, the feeding-out-side bearing portion 202 and the winding-up-side bearing portion 204 are formed on each of the upper casing 152 and the lower casing 150.

The notched parts of the feeding-out-side bearing portion 202 and the winding-up-side bearing portion 204 formed on the lower casing 150 are each integrally formed with the rotation-stop hooks 206 having the tip end thereof facing the feeding-out-side bearing portion 202 and the winding-up-side bearing portion 204. Further, one and the other of rotation-stop hooks 206 engage with the feeding-out core 112 and the winding-up core 116, respectively, in their rotation stopping state.

In the ribbon accommodation area 200, a first ribbon guide 210 that guides the fed-out ink ribbon 110 to the platen roller 120 is integrally formed with the lower casing 150 so as to stand in the vicinity of the feeding-out-side bearing portion 202. In addition, on the outer peripheral side of the opening peripheral wall portion 164, a plurality of second ribbon guides 212 that guides the going-around of the ink ribbon 110 is integrally formed.

That is, inside the cartridge casing 130, a ribbon feeding path 214 ranging from the ribbon roll 114 as a starting point to the winding-up core 116 via the first ribbon guide 210, the platen roller 120, and the plurality of second ribbon guides 212 is constituted. The ink ribbon 110 fed out from the ribbon roll 114 is guided to the platen roller 120 via the first ribbon guide 210 and subjected to printing by the platen roller 120. Moreover, the ink ribbon 110 goes around the opening peripheral wall portion 164 (the plurality of second ribbon guides 212) via the platen roller 120 and is wound up by the winding-up core 116.

Figure 5A:
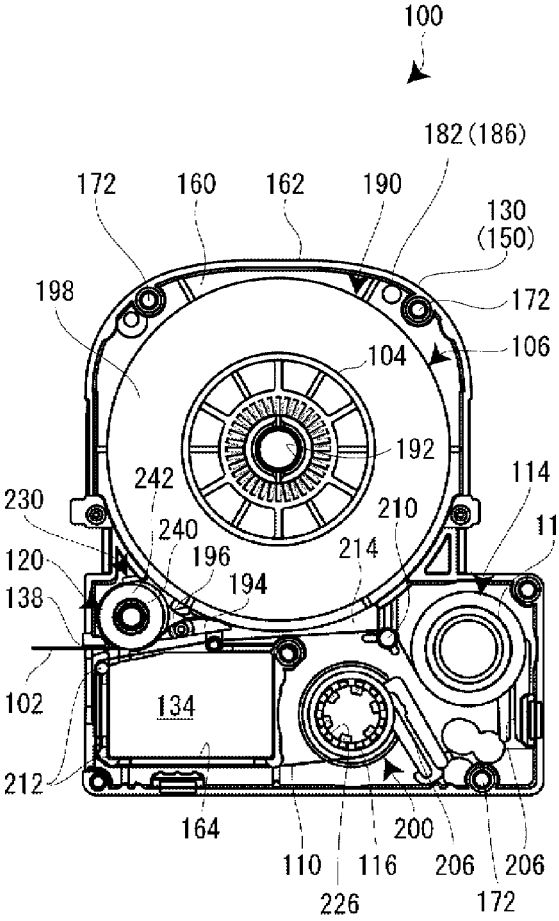
FIGS. 5A and 5B are, respectively, a plan view of the tape cartridge with its upper casing removed and a rear surface view of the upper casing.
Figure 5B:
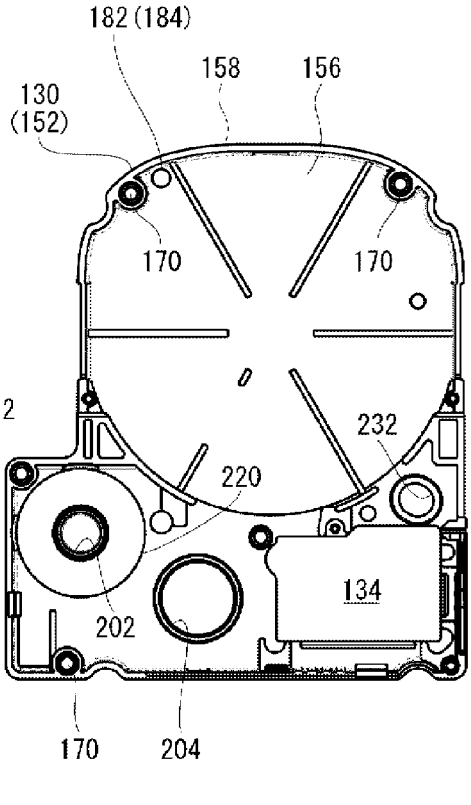

The ribbon roll 114 includes a circular leaf spring 220 that applies a braking load to the feeding-out core 112, besides the ink ribbon 110 and the feeding-out core 112 (see FIG. 5B). The leaf spring 220 is formed to be wavy in the peripheral direction and interposed between the top wall portion 156 of the upper casing 152 and the feeding-out core 112 in the shaft direction. That is, a rotation braking load is applied to the feeding-out core 112 by the elastic force of the leaf spring 220. Thus, back tension is applied to the ink ribbon 110 fed out from the winding-up core 116 to prevent slack in the ink ribbon 110.

The feeding-out core 112 is formed in a cylindrical shape, and a plurality of notches 222 is formed in the peripheral direction at the end thereof on the side of the lower casing 150 (see FIG. 6). Further, the rotation-stop hooks 206 engage with or disengage from the plurality of notches 222. Note that the feeding-out-side bearing portion 202 on the side of the lower casing 150 supporting the feeding-out core 112 is constituted of a circular opening while the feeding-out-side bearing portion 202 on the side of the upper casing 152 is constituted of a cylindrical projection portion. Further, the leaf spring 220 is attached to the projection portion (see FIG. 5B about both of the constituents).

Similarly, the winding-up core 116 is formed in a cylindrical shape, and a plurality of notches 224 is formed in the peripheral direction at the end thereof on the side of the lower casing 150. Further, the rotation-stop hooks 206 engage with or disengage from the plurality of notches 224. In addition, a spline groove 226 is formed on the inner peripheral surface of the winding-up core 116 and spline-engages with the winding-up driving shaft 47. Thus, the rotation force of the winding-up driving shaft 47 is transmitted to the winding-up core 116 to wind up the ink ribbon 110.

On the left side of the base portion inside the cartridge casing 130, a platen accommodation area 230 is constituted adjacent to the insertion opening 134. At the center of the platen accommodation area 230, a lower bearing portion 234 (see FIG. 6) having an elliptical (oval) opening formed on the lower casing 150 and an upper bearing portion 232 (see FIG. 5B) having an elliptical opening formed on the upper casing 152 are provided. Further, by the upper bearing portion 232 and the lower bearing portion 234, the platen roller 120 is supported so as to be rotatable and slightly horizontally movable. That is, the platen roller 120 supported by the elliptical upper bearing portion 232 and the lower bearing portion 234 is configured to be horizontally movable (slightly movable) between a home position at which the platen roller 120 engages with the platen driving shaft 45 and a holding position at which the platen roller 120 comes in contact with the tape guide 194 with the printing tape 102 held therebetween.

Meanwhile, when the tape cartridge 100 is carried, the fed-out end of the printing tape 102 is in a state of slightly projecting from the tape delivering port 138 to an outside (see FIG. 1). If a pressing force or a withdrawing force is falsely applied to the fed-out end of the printing tape 102 at this time, the platen roller 120 pulled by the force is moved to the holding position described above. Thus, the fed-out end of the printing tape 102 is prevented from being withdrawn into the cartridge casing 130 via the tape delivering port 138.

The platen roller 120 includes a cylindrical roller base body 240 and a rubber roller 242 attached to the outer peripheral surface of the roller base body 240. The rubber roller 242 has a length corresponding to the printing head 21 in the shaft direction, and the printing head 21 comes in contact with the rubber roller 242 with the printing tape 102 and the ink ribbon 110 held therebetween when moving to a printing position. In addition, a spline groove 244 is formed on the inner peripheral surface of the roller base body 240 and spline-engages with the rotation driving shaft 49 of the platen driving shaft 45. Thus, the rotation force of the platen driving shaft 45 is transmitted to the platen roller 120 to print-feed the printing tape 102 (and the ink ribbon 110).

Structures of Guided Portion and Guiding Pin (First Embodiment)

Next, with reference to FIG. 7 to FIGS. 9A and 9B, a description will be given in detail of the structures of the guided portion 182 (second guided portion) and the platen roller 120 of the tape cartridge 100 according to a first embodiment in conjunction with the structures of the guide pin 50 (second guide pin) and the platen driving shaft 45 of the cartridge installation portion 5. As described above, the platen driving shaft 45 and the guide pin 50 are provided on the cartridge installation portion 5 so as to separate from each other, and the platen roller 120 and the guided portion 180 are provided in the tape cartridge 100 so as to correspond to the platen driving shaft 45 and the guide pin 50, respectively.

Figure 7:
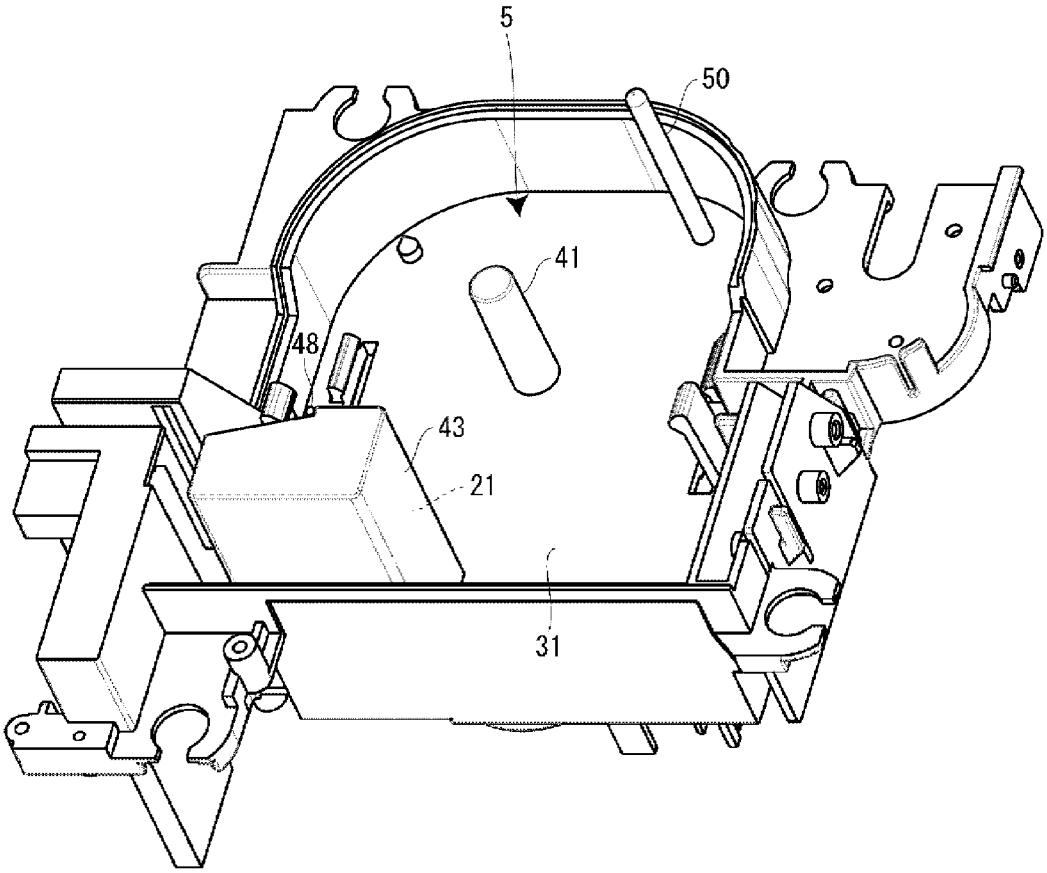
FIG. 7 is an enlarged perspective view of the cartridge installation portion.
Figure 9A:
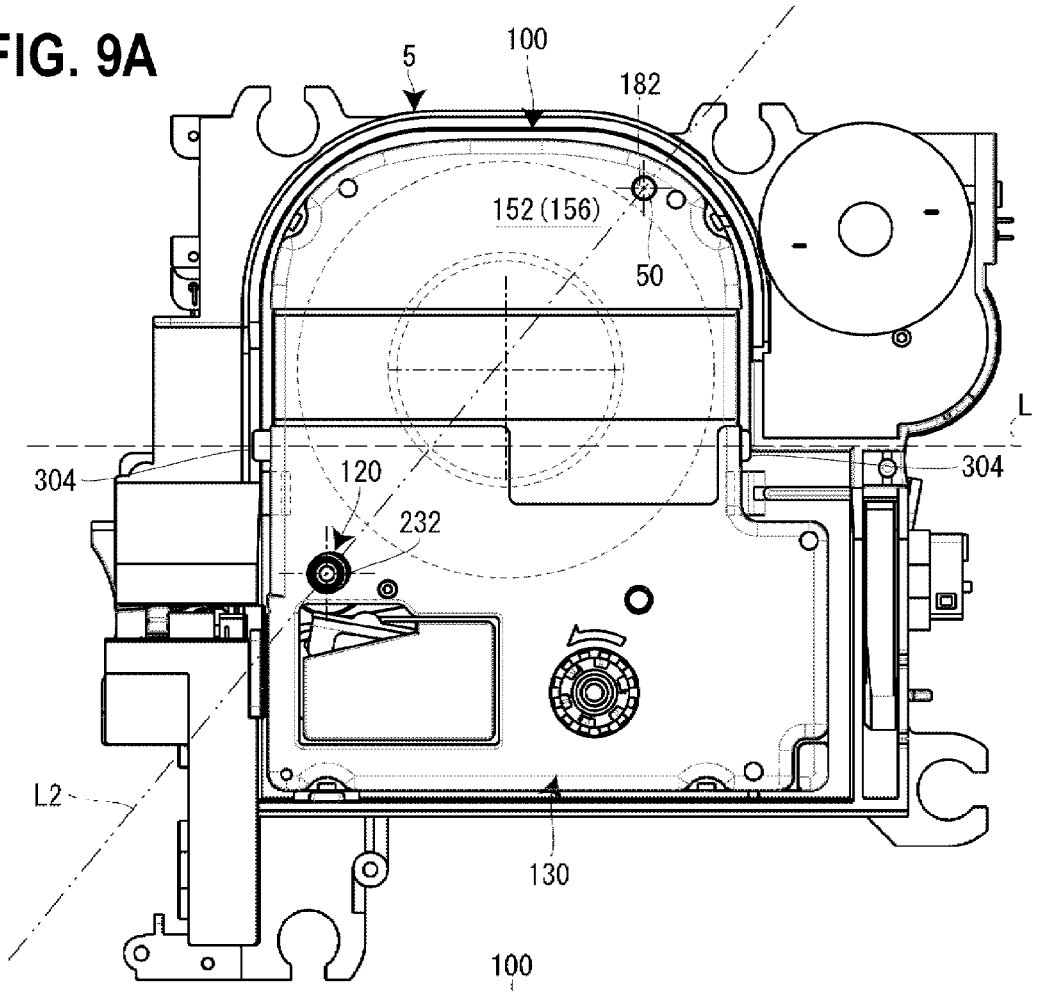
FIGS. 9A and 9B are, respectively, a plan view and a cross-sectional view in a state in which the tape cartridge according to the first embodiment is installed on the cartridge installation portion.
Figure 9B:
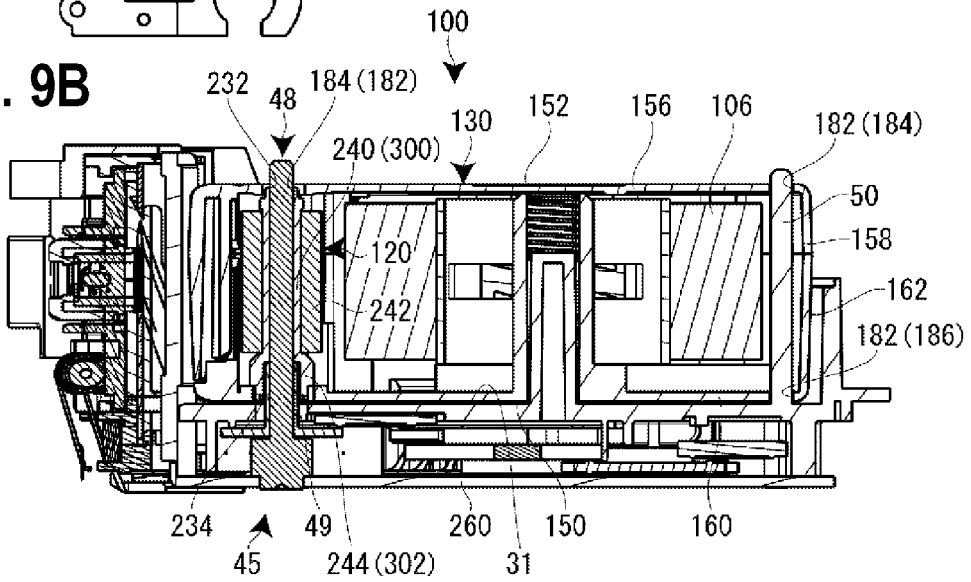

As shown in FIG. 7 and FIGS. 9A and 9B, the platen driving shaft 45 includes a platen supporting shaft 48 (first guide pin) provided to stand on an apparatus frame 260 positioned under the installation base 31 and a rotation driving shaft 49 rotatably supported at the lower portion of the platen supporting shaft 48. The platen supporting shaft 48 is fixed to the apparatus frame 260 at one end thereof and extends in the attaching/detaching direction of the tape cartridge 100 while penetrating the installation base 31. In addition, the platen supporting shaft 48 extends up to a position substantially the same in height as the head cover 43.

When the tape cartridge 100 is installed on the cartridge installation portion 5, the platen supporting shaft 48 is inserted in the roller base body 240 of the platen roller 120. Therefore, the platen supporting shaft 48 (the platen driving shaft 45) rotatably supports the platen roller 120 and functions as a guide for attaching/detaching the tape cartridge 100 via the platen roller 120.

The guide pin 50 is provided to stand on the installation base 31 of the cartridge installation portion 5 and extends in the attaching/detaching direction of the tape cartridge 100 like the platen supporting shaft 48. That is, the guide pin 50 is integrally formed (molded) with the installation base 31 and extends up to a position substantially the same in height as the platen supporting shaft 48. In this case, the guide pin 50 and the platen supporting shaft 48 have a length corresponding to the tape cartridge 100 having the largest thickness. In addition, the tip end of the guide pin 50 is chamfered in a semi-spherical shape to improve the installation of the tape cartridge 100.

When the tape cartridge 100 is installed on the cartridge installation portion 5, the guide pin 50 is inserted in the guided portion 182 of the cartridge casing 130. Thus, the guide pin 50 functions as a guide for attaching/detaching the tape cartridge 100 via the guided portion 182. Note that the guide pin 50 may also be configured to stand on the apparatus frame 260 like the platen supporting shaft 48.

Figure 8:
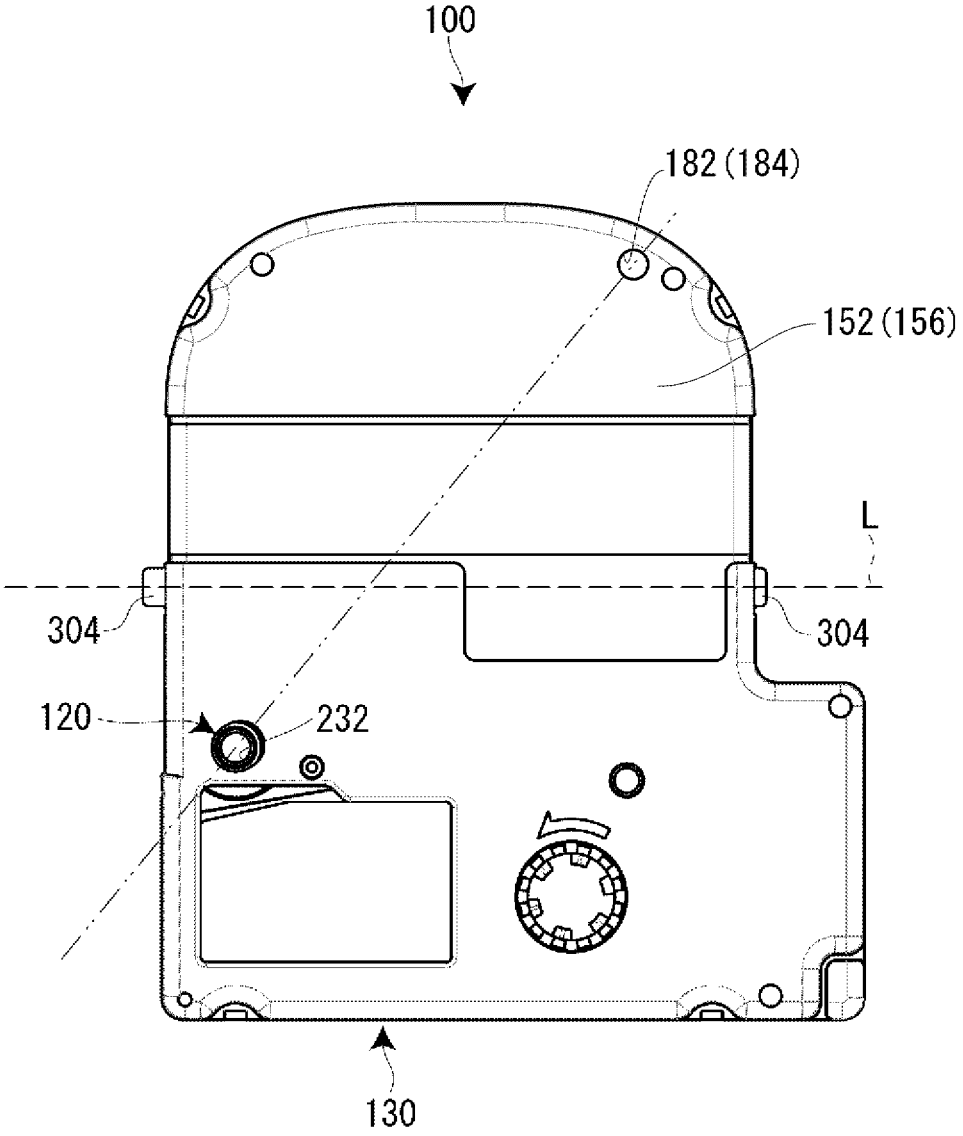
FIG. 8 is a plan view of the tape cartridge according to a first embodiment.

On the other hand, as shown in FIG. 8 and FIGS. 9A and 9B, the platen roller 120 is provided in the tape cartridge 100 so as to be supported by the upper bearing portion 232 of the upper casing 152 and the lower bearing portion 234 of the lower casing 150. In addition, in the tape cartridge 100, the guided portion 182 including the first through hole 184 formed to penetrate the upper casing 152 and the second through hole 186 formed to penetrate the lower casing 150 is provided.

As described above, the platen roller 120 includes the roller base body 240 and the rubber roller 242. The roller base body 240 is integrally formed by a cylindrical roller retention portion 300 (a first guided portion) retaining the rubber roller 242 and a circular engagement portion 302 having the spline groove 244 communicating with the lower side of the roller retention portion 300. In addition, the roller base body 240 is supported by the upper bearing portion 232 and the lower bearing portion 234 of the cartridge casing 130 with slight room and positioned by the platen supporting shaft 48 inserted in (the shaft hole) of the roller retention portion 300.

The first through hole 184 of the guided portion 182 is formed on the top wall portion 156 in the vicinity of the upper peripheral wall portion 158 of the upper casing 152. Similarly, the second through hole 186 is formed on the bottom wall portion 160 in the vicinity of the lower peripheral wall portion 162 of the lower casing 150. That is, the guided portion 182 is formed such that the guide pin 50 inserted in the guided portion 182 is positioned at the gap between the tape roll 106 and the upper peripheral wall portion 158 and the lower peripheral wall portion 162 and arranged along the upper peripheral wall portion 158 and the lower peripheral wall portion 162. Note that if the upper peripheral wall portion 158 and the lower peripheral wall portion 162 are formed to be thick, the guided portion 182 may be formed to penetrate the upper peripheral wall portion 158 and the lower peripheral wall portion 162.

As seen with the upper bearing portion 232 and the lower bearing portion 234 (the circular engagement portion 302 having the spline groove 244) of the platen roller 120, the first through hole 184 and the second through hole 186 exist at far and easily-identifiable places when seen from the side of the upper casing 150 and the side of the lower casing 152. Accordingly, when the tape printing apparatus 1 is put in front of the eyes and the tape cartridge 100 is picked up while seeing the cartridge installation portion 5, the first through hole 184 and the second through hole 186 function as marks by which the front and rear sides of the tape cartridge 100 (the spline groove 244 is easily identifiable since its appearance is different from a simple hole) and the back and forth and the right and left directions thereof are easily identifiable. Thus, the tape cartridge 100 can be oriented in a proper direction and installed on the cartridge installation portion 5.

In addition, the tape cartridge 100 includes a pair of finger-hooking projections 340 (grasping portions) on both right and left side surfaces (graspable surfaces opposite to each other) of the cartridge caring 130. With the pair of finger-hooking projections 340, the fingers are hardly slipped when the tape cartridge 100 is grasped. As a result, the tape cartridge 100 can be reliably grasped. The pair of finger-hooking projections 304 is integrally formed with the right and left outside surfaces of the lower peripheral wall portion 162 of the lower casing 150.

However, the finger-hooking projections 304 are not necessarily required. By partially forming recessed portions 16 on the right and left sides of the side plate portion 33 of the cartridge installation portion 5 of the tape printing apparatus 1, some of the upper peripheral wall portion 158 of the tape cartridge 100 facing the recessed portions 16 can be directly used as grasping portions. In this case, although a force for grasping the tape cartridge 100 is slightly inferior, the design of the tape cartridge 100 can be simplified. As described above, with the first through hole 184 and the second through hole 186 and the upper bearing portion 232 and the lower bearing portion 234 (the circular engagement portion 302 having the spline groove 244) of the platen roller 120 as marks, the front and rear direction of the tape cartridge 100 and the back and forth and the right and left directions thereof can be identified. Accordingly, when the tape cartridge 100 is installed on the cartridge installation portion 5 of the tape printing apparatus 1, some of the upper peripheral wall portion of the tape cartridge 100 corresponding to the recessed portions 16 on the right and left sides of the side plate portion 33 of the cartridge installation portion 5 are used as grasping portions regardless of the presence or absence of the finger-hooking projections 304.

As shown in FIG. 8 and FIGS. 9A and 9B, in the tape cartridge 100 thus configured, the guided portion 182 is, when seen in plan view (seen from the attaching/detaching direction), disposed at the far position of the cartridge casing 130, i.e., the farthest position over an imaginary line L1 connecting the pair of finger-hooking projections 304 (grasping portions) together with respect to the platen roller 120. Further, the distance between the guided portion 182 and the finger-hooking projection 304 (the grasping portion farther from the platen roller 120) corresponding to the right-side grasping portion in FIG. 8 and FIGS. 9A and 9B is shorter than the distance between the guided portion 182 and the finger-hooking projection 304 (the grasping portion closer to the platen roller 120) corresponding to the left-side grasping portion in FIG. 8 and FIGS. 9A and 9B. This positional relationship hardly causes the inclination of the posture of the tape cartridge 100 and the unbalanced application of a force to the tape cartridge 100 when the tape cartridge 100 is installed on the cartridge installation portion 5 of the tape printing apparatus 1 with the two finger-hooking projections 304 (the grasping portions) grasped by the fingers. In addition, the tape cartridge 100 can be smoothly attached/detached without getting snagged, and the platen roller 120 and the guided portion 182 exist at the positions separate from each other so as to be visually identifiable, which eliminates the concern that the installation direction of the tape cartridge 100 is falsely identified.

In addition, the platen supporting shaft 48 (the platen driving shaft 45) and the guide pin 50 of the cartridge installation portion 5 are disposed so as to correspond to the arrangement positions of the platen roller 120 and the guided portion 182, respectively. Further, the manufacturing positional errors between the platen roller 120 and the guided portion 182 and the platen supporting shaft 48 and the guide pin 50 are absorbed since the platen roller 120 is journaled in the cartridge casing 130 with room.

Structures of Guided Portion and Guide Pin (Second Embodiment)

Next, with reference to FIG. 10, a description will be given in detail of the structures of a guided portion 182A and a platen roller 120 of a tape cartridge 100A according to a second embodiment in conjunction with the structures of a guide pin 50 and a platen driving shaft 45 of a cartridge installation portion 5. In addition, components different from those of the first embodiment will be mainly described in the second embodiment.

Figure 10:
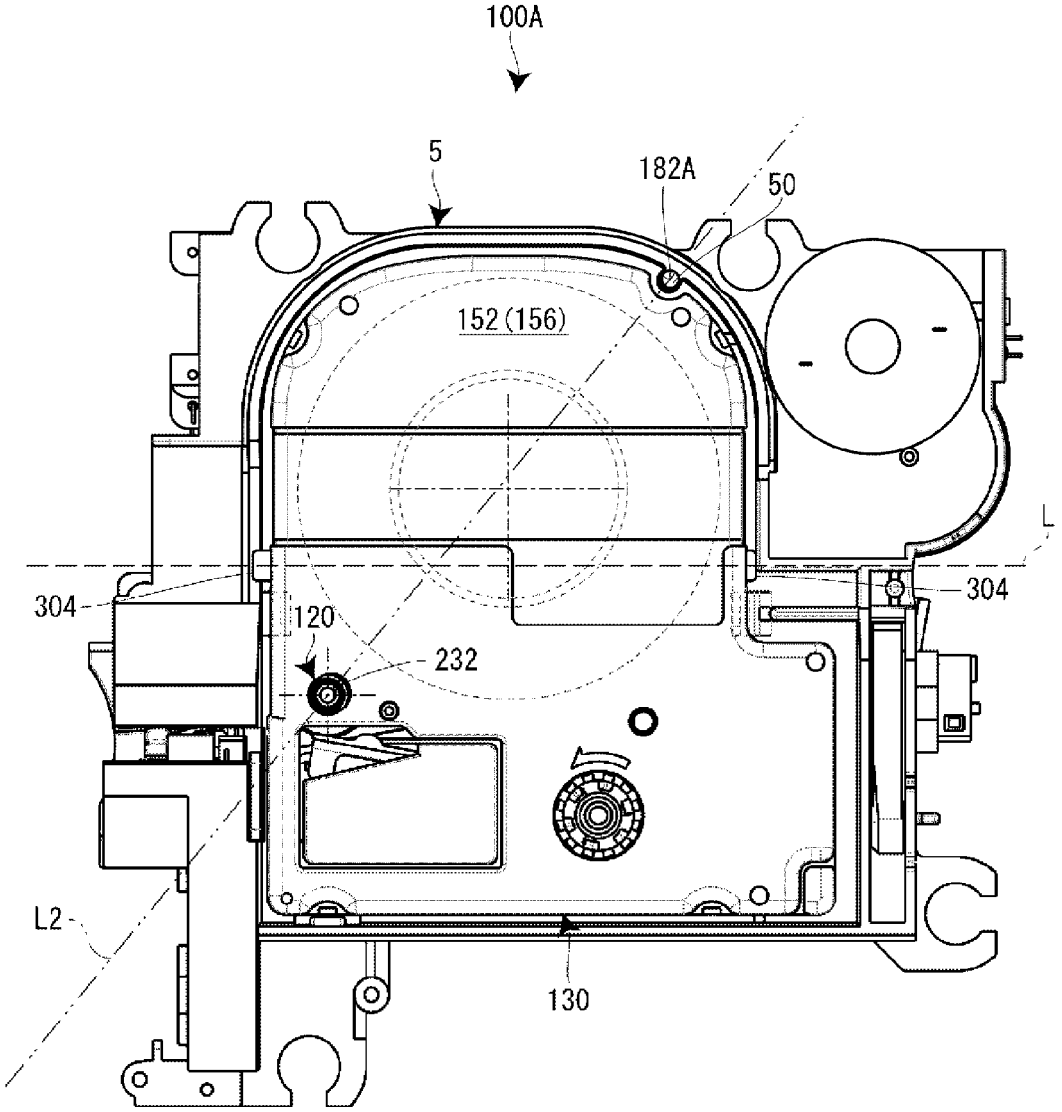
FIG. 10 is a plan view in a state in which a tape cartridge according to a second embodiment is installed on a cartridge installation portion.

As shown in FIG. 10, the guided portion 182A of the tape cartridge 100A of the second embodiment is recessed as a groove on the outer peripheral surface of a cartridge casing 130. Specifically, the guided portion 182A is recessed to be formed in a substantially semi-circular shape toward the side of the platen roller 120 on an upper peripheral wall portion 158 of a lower casing 150 and a lower peripheral wall portion 162 of the lower casing 150. When an imaginary line L2 connecting the platen roller 120 and the guided portion 182A together is assumed, the guided portion 182A as a groove is recessed in a direction in which a wall is formed at a position crossing the imaginary line L2. Therefore, the tape cartridge 100A is effectively guided by the wall at its attachment/detachment.

In this case as well, the guided portion 182A is disposed at the far position of the cartridge casing 130, i.e., the farthest position over an imaginary line L1 connecting a pair of finger-hooking projections 304 together with respect to the platen roller 120A. In addition, a platen supporting shaft 48 (a platen driving shaft 45) and the guide pin 50 of the cartridge installation portion 5 are disposed so as to correspond to the arrangement positions of the platen roller 120 and the guided portion 182A, respectively.

As described above, the guided portions 182 and 182A are disposed at the far positions of the cartridge casing 130, i.e., the farthest positions over the imaginary line L1 connecting the pair of finger-hooking projections 304 together with respect to the platen roller 120. Therefore, with the platen roller 120 and the guided portions 182 and 182A as marks, the tape cartridge 100 and 100A can be grasped at the two finger-hooking projections 304 in a proper direction. In addition, when the tape cartridge 100 and 100A is attached/detached to/from the cartridge installation portion 5 of the tape printing apparatus 1, a force applied to the tape cartridges 100 and 100A via the pair of finger-hooking projections 304 is relatively uniformly applied to the guided portions 182 and 182A and the platen roller 120. This hardly causes the inclination of the posture of the tape cartridge 100 and 100A and the unbalanced application of a force to the tape cartridge 100, and thus the tape cartridge 100 can be smoothly attached/detached without getting snagged. That is, when the tape cartridge 100 is attached/detached in its proper position, a force for attaching/detaching the tape cartridge 100 can be uniformly applied to the guided portions 182 and 182A and the platen roller 120 having large friction resistance. Thus, the tape cartridges 100 and 100A can be smoothly attached/detached to/from the cartridge installation portion 5 without being inclined.

In addition, since the guided portions 182 and 182A are arranged so as to substantially separate from the platen roller 120, a force for installing or pulling the tape cartridges 100 and 100A is hardly biased. In this regard as well, the tape cartridges 100 and 100A can be smoothly attached/detached to/from the cartridge installation portion 5. Note that although the guide pin 50 and the guided portion 182 of the embodiment are formed in the circular shapes in cross section, they may be formed in semi-circular shapes, polygonal shapes, or the like in cross section. In addition, if a feeding roller is provided separately from the platen roller 120 (platen) or instead of the platen roller 120, the supporting shaft of the feeding roller may function as an attachment/detachment guide instead of the platen supporting shaft 48.

What is claimed is:

1. A tape cartridge detachably installed on a cartridge installation portion of a tape printing apparatus having a first shaft and a second shaft on the cartridge installation portion, the tape cartridge comprising:

a tape accommodation area in which a printing tape and a tape core are accommodated;

a platen that has a first reception portion in which the first shaft is inserted when the tape cartridge is installed in the cartridge installation portion; and a second reception portion into which the second shaft is inserted when the tape cartridge is installed in the cartridge installation portion, wherein when seen from an attaching direction of the tape cartridge, the tape cartridge has an appearance that is formed in an L-shape and of which a base end at a right side surface slightly projects, and when seen from the attaching direction of the tape cartridge, the second reception portion is arranged, with respect to the tape accommodation area, opposite to the first reception portion in a first direction perpendicular to a base end surface of the tape cartridge and in a second direction parallel to the base end surface.

2. The tape cartridge according to claim 1, wherein, when seen from the attaching direction of the tape cartridge, an imaginary line connecting the first reception portion and the second reception portion overlaps on the tape core.

3. The tape cartridge according to claim 1, wherein the second reception portion includes a penetratingly-formed through hole.

4. The tape cartridge according to claim 3, wherein the tape cartridge includes a cartridge casing having a shell structure made of a top wall portion on a near side in the attaching direction and a bottom wall portion on a back side in the attaching direction and a peripheral wall portion, and the second reception portion is provided on the top wall portion and the bottom wall portion.

5. The tape cartridge according to claim 4, wherein the through hole includes:

a first through hole penetratingly formed on the top wall portion, and a second through hole penetratingly formed on the bottom wall portion.

6. The tape cartridge according to claim 1, wherein the tape cartridge includes a cartridge casing, and the second reception portion includes a groove recessed on an outer peripheral surface of the cartridge casing.

7. The tape cartridge according to claim 6, wherein the groove is recessed in a direction crossing an imaginary line connecting the first reception portion and the second reception portion together.

8. The tape cartridge according to claim 6, wherein the groove is a guide groove.

9. The tape cartridge according to claim 1, wherein the platen includes a platen roller having the first reception portion, and the platen is rotatably supported by the first shaft via the first reception portion when the tape cartridge is installed on the cartridge installation portion.

10. The tape cartridge according to claim 1, wherein the first reception portion is a shaft hole.

11. The tape cartridge according to claim 1, wherein the first reception portion is a through hole.

12. The tape cartridge according to claim 1, wherein the first reception portion is a guide hole.

13. The tape cartridge according to claim 1, wherein the second reception portion is a guide hole.

* * * * *